US009669523B2

(12) United States Patent
Lu et al.

(10) Patent No.: US 9,669,523 B2
(45) Date of Patent: Jun. 6, 2017

(54) SCREWDRIVER

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Li-Chin Lu, New Taipei (TW); Jian-Hua Xiang, Shenzhen (CN); Xue Mou, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 360 days.

(21) Appl. No.: 14/325,572

(22) Filed: Jul. 8, 2014

(65) Prior Publication Data

US 2015/0013509 A1 Jan. 15, 2015

(30) Foreign Application Priority Data

Jul. 9, 2013 (CN) ..... 2013 1 0285959

(51) Int. Cl.
*B25B 15/06* (2006.01)

(52) U.S. Cl.
CPC ..... *B25B 15/06* (2013.01)

(58) Field of Classification Search
CPC ..... B25B 15/06; B25B 13/48; B25B 13/481; B25B 13/5091; B25B 17/00; E21B 19/16
See application file for complete search history.

(56) References Cited

U.S. PATENT DOCUMENTS 2,947,334 A * 8/1960 Issartel ..... B23B 45/06 74/127
3,802,517 A * 4/1974 Cooke-Yarborough B25B 23/145 173/18
4,577,522 A * 3/1986 Cox, Jr. ..... B25B 15/06 74/127
7,159,493 B1 * 1/2007 Huang ..... B25B 23/0035 81/177.85

FOREIGN PATENT DOCUMENTS

GB 867602 * 5/1961

* cited by examiner

*Primary Examiner* — Robert Scruggs
(74) *Attorney, Agent, or Firm* — Steven Reiss

(57) ABSTRACT

A screwdriver includes a screw rod including a first end and a second end opposite to the first end. The screwdriver defines a screw slot on an external portion adjacent to the second end. The screwdriver further includes a screwdriver bit fixed to the first end of the screw rod, a resisting portion fixed to the second end of the screw rod, a handle placed over a portion of the screw rod adjacent to the second end. A movable element fixed to an inside wall of the handle and tightly closed to an inside surface of the screw slot, and an elastic element placed over the screw rod between the first end and the handle.

6 Claims, 4 Drawing Sheets

SCREWDRIVER

CROSS-REFERENCE TO RELATED APPLICATIONS

This application claims priority to Chinese Patent Application No. 201310285959.X filed on Jul. 9, 2013 in the China Intellectual Property Office, the contents of which are incorporated by reference herein.

FIELD

The present disclosure relates to drivers, and particularly to a screwdriver.

BACKGROUND

When assembling electronic devices, a screwdriver is needed to drive screws into screw holes to pass through, or secure, an element.

DETAILED DESCRIPTION

Figure 1:
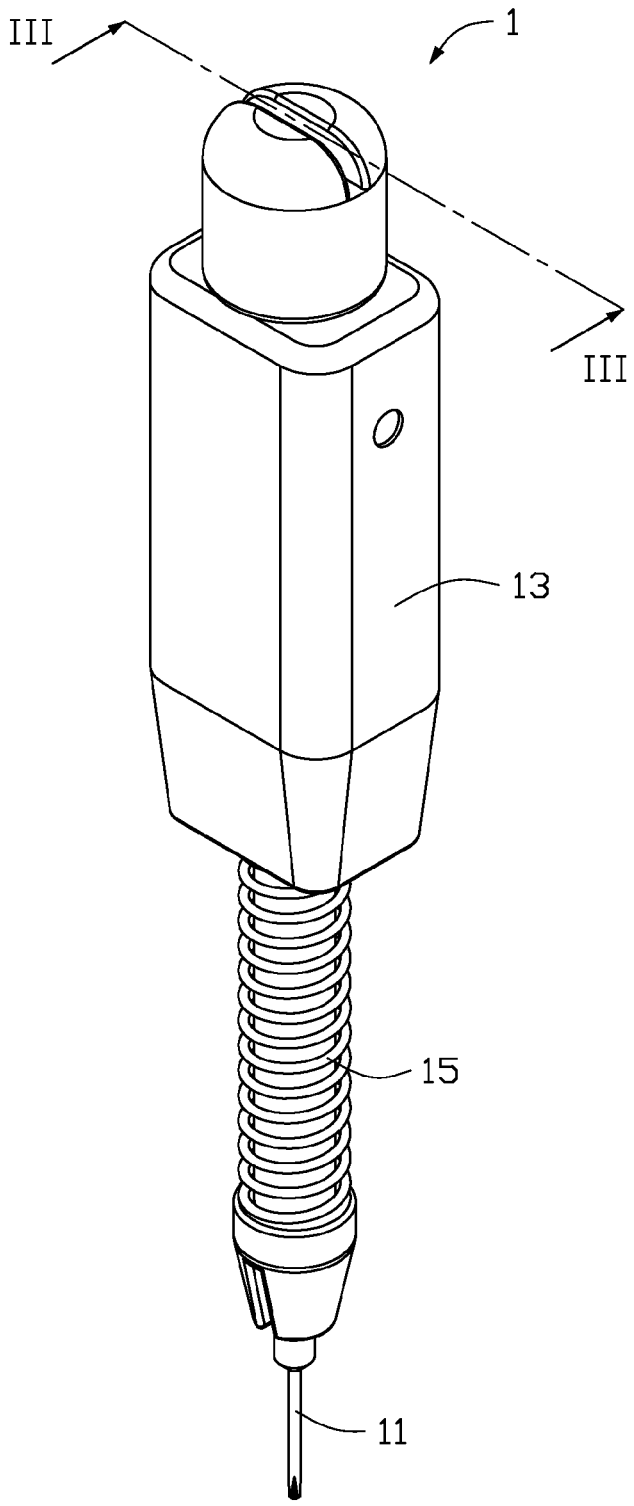
FIG. 1 is an isometric view of a screwdriver.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "inside" indicates that at least a portion of a region is partially contained within a boundary formed by the object. The term "comprising" means "including, but not necessarily limited to"; it specifically indicates open-ended inclusion or membership in a so-described combination, group, series and the like.

Embodiments of the present disclosure will be described with reference to the accompanying drawings.

Figure 2:
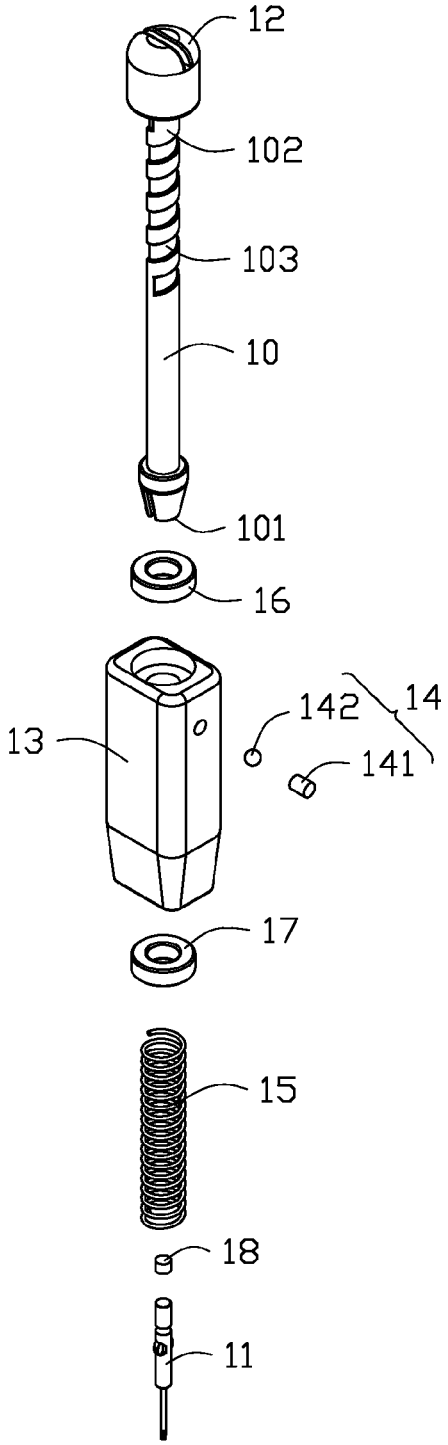
FIG. 2 is an exploded view of the screwdriver of FIG. 1.

FIG. 1 illustrates a screwdriver 1 of the embodiment. FIG. 2 illustrates that the screwdriver 1 includes a screw rod 10, a screwdriver bit 11 fixed to a first end 101 of the screw rod

10, a resisting portion 12 fixed to a second end 102 of the screw rod 10, and a handle 13 placed over a portion of the screw rod 10 adjacent to the second end 102. The screw rod 10 defines a screw slot 103 on an external portion adjacent to the second end 102.

The screwdriver 1 further includes a movable element 14 fixed to an inside wall of the handle 13 and tightly closed to an inside surface of the screw slot 103. The screwdriver 1 further includes an elastic element 15 placed over the screw rod 10 between the first end 101 and the handle 13. In at least one embodiment, the elastic element 15 is a spring. The movable element 14 includes a metal body 141 and a metal ball 142. The metal body 141 is fixed to the inside wall of the handle 13, and the metal ball 142 is placed between the metal body 141 and the inside surface of the screw slot 103.

The screwdriver 1 further includes a first bearing 16 and a second bearing 17 placed over two opposite ends of the screw slot 103. The first bearing 16 is adjacent to the second end 102. The second bearing 17 is away from the second end 102. Two opposite ends of the handle 13 are fixed to the first bearing 16 and the second bearing 17. One end of the elastic element 15 is fixed to the first end 101 of the screw rod 10. An opposite end of the elastic element 15 resists the second bearing 17, thereby limiting a position of the elastic element 15 between the first end 101 of the screw rod 10 and the second bearing 17. In at least one embodiment, the first end 101 of the screw rod 10 is a frustum.

Figure 3:
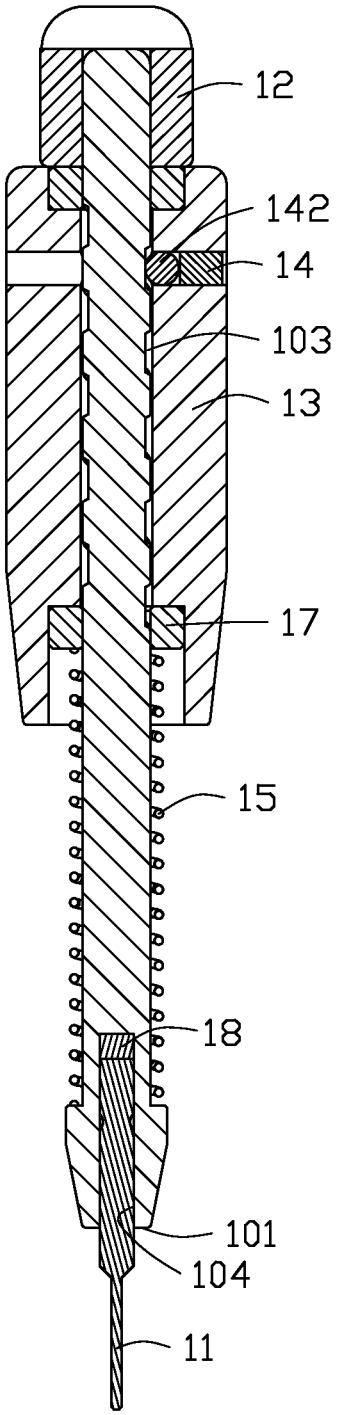
FIG. 3 is a cross-sectional, perspective view of the screwdriver of FIG. 1, taken along line III-III, in an initial state.

FIG. 3 illustrates that the screw rod 10 further defines a blind hole 104 on the first end 101. The screwdriver 1 further includes a magnet 18 received in the blind hole 104. In one embodiment, the screw rod 10 and the screwdriver bit 11 are made of a metal material. The magnet 18 attracts the screw rod 10 and the screwdriver bit 11 to fix the screwdriver bit 11 on the screw rod 10. In another embodiment, the screwdriver bit 11 can be fixed to the screw rod 10 by a screw.

When using the screwdriver 1, an external force is applied to the handle 13 to drive the handle 13 with the movable element 14 to move along the screw rod 10 from the first end 101 to the second end 102. During a movement of the movable element 14, the metal ball 142 is moved along the screw slot 103 to drive the screw rod 10 to rotate. During the movement of the movable element 13, the second bearing 17 compresses the elastic element 15.

Figure 4:
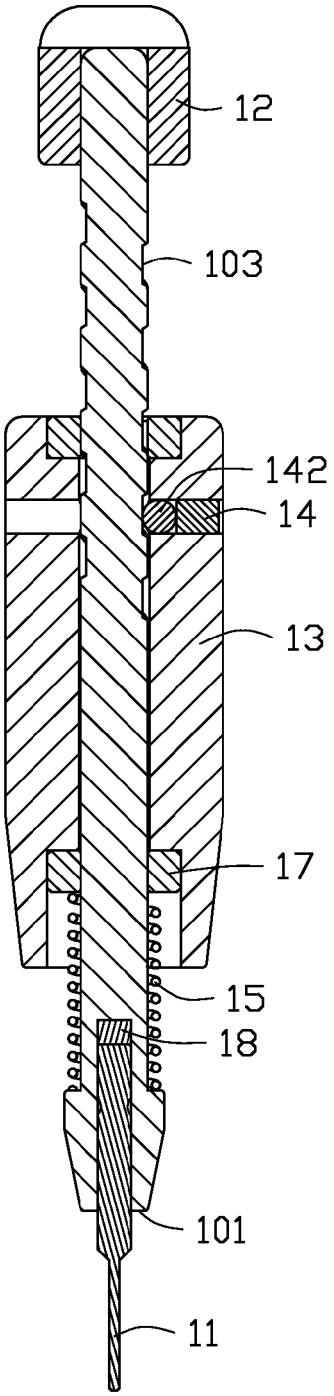
FIG. 4 is a cross-sectional, perspective view of the screwdriver of FIG. 1, taken along line III-III, in a working state.

FIG. 4 illustrates when the screwdriver 1 is not needed to be used, the external force is released. The elastic element 15 rebounds to drive the handle 13 and the movable element 14 to return to an original position. During a rebounding process, the resisting portion 12 is used to avoid the handle 13 from being moved out of the screw rod 10.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A screwdriver comprising:

a rod comprising a first end and a second end opposite the first end, the rod forming a slot on an external portion adjacent to the second end;

a screwdriver bit releasably coupled to the first end of the rod;

a resisting portion coupled to the second end of the rod;

a handle forming a through hole configured to receive the rod and having an end that is configured to be adjacent to the second end of the rod;

a movable element coupled to an inside wall of the handle and configured to engage with the slot; and an elastic element located around the rod between the first end of the rod coupled to the screwdriver bit and the handle, wherein, the first end is a frustum.

2. The screwdriver as described in claim 1, further comprising:

a first bearing and a second bearing placed around on two opposite ends of the screw slot of the rod, wherein the first bearing is adjacent to the second end of the rod, the handle is fixed to the first bearing and the second bearing, one end of the elastic element is fixed to the first end of the screw rod, and another end of the elastic element resists the second bearing.

3. The screwdriver as described in claim 2, wherein the first end of the rod is a frustum.

4. The screwdriver as described in claim 1, wherein the elastic element is a spring.

5. The screwdriver as described in claim 1, wherein the rod defines a blind hole on the first end, the screwdriver further comprises a magnet received into the blind hole, the rod and the screwdriver bit are made of metal material.

6. The screwdriver as described in claim 1, wherein the movable element comprises a metal body and a metal ball, the metal body is fixed to an inside wall of the handle, and the metal ball is placed between the metal body and the inside surface of the screw slot.

* * * * *